US006373680B1

(12) United States Patent
Riskin

(10) Patent No.: US 6,373,680 B1
(45) Date of Patent: Apr. 16, 2002

(54) METHOD AND DEVICE FOR ION GENERATION

(75) Inventor: Yefim Riskin, Katzrin (IL)

(73) Assignee: Ionics-Ionic Systems Ltd. (IL)

( * ) Notice: Subject to any disclaimer, the term of this patent is extended or adjusted under 35 U.S.C. 154(b) by 0 days.

(21) Appl. No.: 09/568,606

(22) Filed: May 10, 2000

Related U.S. Application Data

(63) Continuation of application No. PCT/IL97/00363, filed on Nov. 10, 1997.

(51) Int. Cl.[7] ..... H01T 23/00; H01T 19/04
(52) U.S. Cl. ..... 361/231; 361/232; 250/324
(58) Field of Search ..... 361/212, 213, 361/220, 230, 231, 232, 235; 96/63, 95, 97; 250/324–326; 399/170–172

(56) References Cited

U.S. PATENT DOCUMENTS

| | | | | |
|---|---|---|---|---|
| 3,696,269 A | * | 10/1972 | Hochheiser et al. | 361/231 |
| 4,102,654 A | * | 7/1978 | Pellin | 96/16 |
| 4,542,434 A | | 9/1985 | Gehlke | |
| 4,643,745 A | | 2/1987 | Sakakibara | |
| 4,872,083 A | | 10/1989 | Blitshteyn | |
| 4,901,194 A | | 2/1990 | Steinman | |
| 4,985,716 A | * | 1/1991 | Hosaka et al. | 346/159 |
| 5,055,963 A | | 10/1991 | Partridge | |
| 5,153,811 A | * | 10/1992 | Rodrigo et al. | 361/231 |
| 5,468,454 A | | 11/1995 | Kim | |
| 5,542,967 A | | 8/1996 | Ponizovsky | |
| 5,656,063 A | | 8/1997 | Hsu | |

FOREIGN PATENT DOCUMENTS

| | | |
|---|---|---|
| WO | WO 95/19225 | 7/1995 |

* cited by examiner

*Primary Examiner*—Josie Ballato
*Assistant Examiner*—Kim Huynh
(74) *Attorney, Agent, or Firm*—Davis Wright Tremaine LLP

(57) ABSTRACT

A method of high efficiency generation of ions of desired polarity, which includes the steps of positioning a first electrode at a predetermined spacing from a second electrode having a closed shape configuration, applying to both electrodes a direct voltage of the same polarity, at the same time as applying the direct voltage, applying high voltage pulses to the first electrode only, thereby to cause ion generation in the vicinity of the first electrode and to set up a rapidly moving ion stream from the first to the second electrode along an electrical field therebetween, wherein the duration of the pulses is shorter than the time taken for the ion stream to reach the second electrode, and wherein ions in the ion stream have the same polarity as the second electrode, thereby to be repelled and concentrated as they flow through the second electrode. The method may also include the generation of a stream of ions, with reduced ozone content, which includes the additional step of applying a negative pressure gradient to the ion stream, thereby to deflect ozone generated by the corona discharge to a direction different from that of the flow of ions.

13 Claims, 1 Drawing Sheet

METHOD AND DEVICE FOR ION GENERATION

This application is a continuation of International application No. PCT/IL97/00363, international filing date Nov. 10, 1997.

FIELD OF THE INVENTION

The present invention relates to ion generation.

DEFINITIONS

The term "efficiency" as used herein, relates to the proportion of ions exiting a device for ion generation, relative to the total volume produced. The efficiency is also referred to herein as may the coefficient of ion exit.

BACKGROUND OF THE INVENTION

It is known that besides ions, neutral ozone molecules are simultaneously produced in the field of a corona discharge.

In prior art methods and devices for ion generation, ions are removed from the corona system by means of an air flow from a fan or a compressor. Accordingly, the ion flow direction to the generator exit coincides with that of the air flow.

Due to the great difference between the speed of the air flow and that of the ions in the field of a corona discharge, a significant part of the ion stream remains inside the system. Thus by the known method and known devices, the coefficient of ion removal from the generator the ratio of the ions quantity at the output of the generator to the number of ions produced by the generator remains rather low.

At the same time together with ions the whole amount of ozone produced in the corona system is also removed by the air flow.

An indication of the state of the art is provided by the following patent publications: PCT application no. WO95/19225, entitled Air Cleaning Apparatus, and U.S. Pat. No. 5,055,963, entitled Self-Balancing Bipolar Air Ionizer, employ fans. In WO95/19225, a fan is provided so as to produce an inflow of air to be cleaned. In U.S. Pat. No. 5,055,963, a fan "draws air into the housing through the inlet passage and directs air out of the housing . . . " for promoting "intermixing of . . . positive and negative ions as the air flow travels through the outlet passage" column 3, lines 4–9.

SUMMARY OF THE INVENTION

The present invention seeks to provide a method and device for generating ions which are characterized by an efficiency which is substantially greater than in the known art.

The present invention further seeks to provide a method and device for substantially reducing the emission of ozone from the device, the generation of which accompanies corona discharge generation of ozone.

There is thus provided, in accordance with a preferred embodiment of the invention, a method of high efficiency generation of ions of desired polarity, which includes the steps of positioning a first electrode at a predetermined spacing from a second electrode having a closed shape configuration, applying to both electrodes a direct voltage of the same polarity, at the same time as applying the direct voltage, applying high voltage pulses across the first electrode only, thereby to cause ion generation in the vicinity of the first electrode and to set up a rapidly moving ion stream from the first to the second electrode along an electrical field therebetween, wherein the duration of the pulses is shorter than the time taken for the ion stream to reach the second electrode, and wherein ions in the ion stream have the same polarity as the second electrode, thereby to be repelled and concentrated as they flow through the second electrode.

Additionally in accordance with a preferred embodiment of the present invention, the coefficient of ion removal is regulated by changing the magnitude of direct voltage supplied to the electrodes.

In accordance with an alternative embodiment of the invention, there is also provided a device for performance of the above method.

In accordance with an additional embodiment of the invention, there is provided a method for the generation of a stream of ions, with reduced ozone content, which includes positioning a first electrode opposite a second electrode and applying predetermined electrical charges across the first and second electrodes so as to generate an ion stream by corona discharge; and applying a negative pressure gradient to the ion stream, thereby to deflect ozone generated by the corona discharge to a direction different from that of the flow of ions.

There is also provided a device for implementing this method.

BRIEF DESCRIPTION OF THE DRAWINGS

The present invention will be more fully understood and appreciated from the following detailed description, taken in conjunction with the drawing, in which.

DETAILED DESCRIPTION OF THE INVENTION

Figure 1:
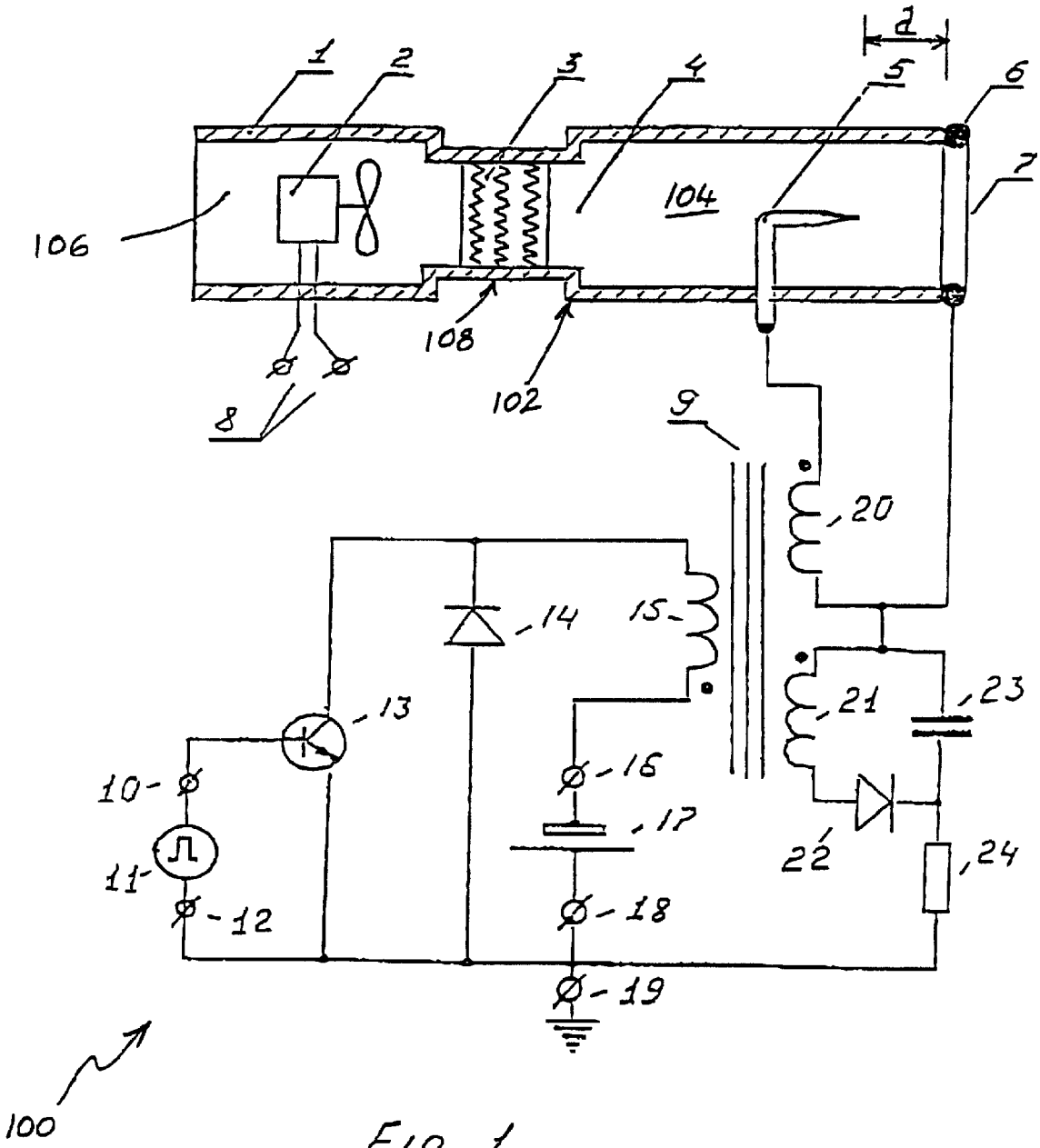
FIG. 1 is a diagrammatic representation of an ion generation device, constructed and operative in accordance with a preferred embodiment of the invention.

Referring now to FIG. 1, there is seen an ion generation device, referenced generally 100, constructed and operative in accordance with a preferred embodiment of the present invention. The device 100 includes a housing 102, which has a front chamber 104 in which an ion stream is generated, and a rear chamber 106, for neutralizing ozone. Chambers 104 and 106 are connected at an intermediate location 108 which, as will be appreciated from the following description, serves as an ozone outlet.

Front chamber 104 has located therein an active electrode 5 which is operated so as to provide generation of ions by corona discharge, and which typically is needleshaped, although any other suitable shape can also be used. Front chamber has an ion exit port, referenced 7, at which is located a passive electrode 6. Passive electrode 6 is illustrated, by way of example, as being a ring or torroid, but any other closedshape electrode may be used in place thereof.

The rear chamber 106 has located therein a negative pressure source, referenced 2, such as an extractor fan, or the like. Under the influence of the negative pressure source 2, ozone which is produced during ion production, is removed under negative pressure through the upstream ozone outlet 108, and through an adsorbing filter 3, such as an active carbon filter, located thereat.

In general terms, a constant direct voltage of polarity conforming to a required ion polarity is supplied to both the active and passive inactive electrodes, 5 and 7 respectively.

Simultaneously a high pulse voltage of determined frequency is applied to the active electrode relative to the inactive one, with voltage polarity corresponding the required ion polarity, thereby to establish an electrical field between active electrode 5 and passive electrode 7, causing an ion flow along the electrical field, towards passive electrode 7, for the duration of the pulse. The duration of the high voltage pulse, at the particular amplitude is chosen to be shorter than the time it takes the ions to reach the inactive electrodes. During the high voltage pulse positive and negative ions as well as neutral ozone molecules are produced near the sharp point of the active electrode, due to the well known corona discharge phenomenon.

Under the effect of the electric field forces ions begin moving from the active to the inactive electrodes at a relatively high speed, in the range 1–2 cm/sec/volt. In a case in which the voltage pulse is 6 kV, this gives an ion flow speed in the range 6,000–12,000 cm/sec.

The time duration of high voltage pulse under the particular amplitude, is chosen to be shorter than the time it takes the ions to pass from the active to the passive electrode, and thus during the period of the pulse duration the ions cannot reach the inactive electrode.

As mentioned above, both of the electrodes are connected to a common current source. Accordingly, in the period between pulses, a potential of equal magnitude and polarity is applied to both electrodes, the polarity being the same as that of the ions in the ion stream. During this period, despite the absence of an electrical field between the electrodes, the ions continue moving toward passive electrode 7 under inertia and, as the ions and the passive electrode 7 both carry a charge with the same polarity, the ion stream is repelled generally radially by the electrode 7, so as to be focused and thus to exit the device in a generally concentrated stream. This results in a high coefficient of ion removal from the device.

Ozone produced during the ion generation is removed under a negative pressure gradient, by means of a fan or compressor 3, through the ozone outlet 108, and is neutralized by means of adsorption filter 3, thereby removing ozone in the ion stream. The velocity at which the ozone is removed may reach, for example, 100 cm/sec, and is thus much slower than the speed of the ion stream, exemplified above as being in the range 6,000–12,000 cm/sec.

Referring now in more detail to FIG. 1, it is seen that power is supplied to the fan 2 by means of wires 8 and the fan 2 is placed in the housing 1 so that the air flow generated by it is directed from the ion removal opening 7 to the ozone removal opening 4. The pulse and direct voltages necessary for the novel method is produced by commutation of the current flowing through the primary winding 15 of the high voltage pulse transformer 9 from the direct voltage source 17. Transistor 13 is used as a commutating element. Damping diode 14 presents the ejection of the reversed polarity voltage.

The pulse frequency is determined by a commutative pulse generator 11. Clamp 10 of generator 11 is connected to the base of transistor 13 whole collector is connected to the cathode of diode 14 and to the end of the primary Winding 15 of the transformer 9. The front end of the winding 15 is connected to the positive clamp 16 of the direct voltage source 17, while its negative clamp 18 is connected to the anode of diode 14, to the transistor 13 emitter, to a ground terminal 19, and to the clamp 12 of the generator 11.

The pulses produced on the primary winding 15 are raised by the transformer 9 and a high pulse voltage is applied to the secondary windings 20 an of the high voltage pulse 21 of transformer 9.

The front end of the winding 20 is connected to the active electrode 5 and the end of it to the inactive electrode 6, to the front end of the winding 21 and to one of the plates of capacitor 23. The second plate of capacitor 23 is connected to the cathode of diode 22 and by resistor 24 to ground terminal 19. The anode of diode 22 is connected to the end of winding 21.

The pulse voltage on winding 21 charges the capacitor 23 up to the peak value, and the capacitor 23 acts as direct voltage source. For safety, in order to limit the electric current intensity there is provided resistor 24.

It will be appreciated that the above-described circuitry is by way of example only, and that any alternative means for providing the same mode of operation as described above, may also be used.

By way of non-limiting example only, device 100 may be formed and operated in accordance with the following:

1. The distance 'd' between the active and inactive electrodes may be in the order 0.5 mm;
2. The amplitude of the high voltage pulses may be in the region of 6 kV;
3. Pulse duration—approximately 1 microsecond
4. Pulse frequency—approximately 5.0 kHz
5. The direct voltage supplied to electrodes 5 and 7 may be approximately 2.4 kV, at a current of 1 microampere.

The inventor has found that device 100, when manufactured and operated in accordance with the above technical specifications, has an efficiency in the region of 80%.

It will be appreciated by persons skilled in the art that a current increase can be achieved both by amplitude and frequency of high voltage pulses increase and by arrangement of several active and inactive electrodes in the housing.

It will further be appreciated by persons skilled in the art that the present invention is not limited by what has been particularly shown and described hereinabove. Rather the scope of the present invention is defined only by the claims, which follow.

What is claimed is:

1. A method of high efficiency generation of ions of desired polarity, which includes the following steps:

positioning a first electrode at a predetermined spacing from a second electrode having a closed shape configuration;

applying to both electrodes a direct voltage of the same polarity;

at the same time as applying the direct voltage, applying high voltage pulses across the first electrode only, thereby to cause ion generation in the vicinity of the first electrode and to set up a rapidly moving ion stream from the first to the second electrode along an electrical field therebetween; and wherein ions in the ion stream have the same polarity as the second electrode, thereby to be repelled and concentrated as they flow through the second electrode.

2. A method according to claim 1, where the duration of the pulses is shorter than the time taken for the ion stream to reach the second electrode.

3. A method according to claim 1, where the coefficient of ion removal is regulated by changing the magnitude of direct voltage supplied to the electrodes.

4. A method for the generation of a stream of ions, with reduced ozone content, which includes:

positioning a first electrode opposite a second electrode and applying predetermined electrical charges across the first and second electrodes so as to generate an ion stream by corona discharge; and applying a negative pressure gradient to the ion stream, thereby to deflect ozone generated by the corona discharge to a direction different from that of the flow of ions.

5. A method according to claim 4, wherein said step of applying a negative pressure gradient comprises causing an ozone flow in a direction opposite to the flow of the ion stream.

6. A method according to claim 4, where the airstream with the ozone is passed through a suitable filter for ozone removal.

7. A device for the high efficiency generation of ions of desired polarity including:

first and second electrodes spaced apart by a predetermined spacing;

means for applying a direct voltage to both electrodes relative to the earth;

means for applying high voltage pulses of a predetermined amplitude to said first electrode, thereby to cause pulsed ion stream to flow from said first electrode towards said second electrode along an electrical field established therebetween during said pulses.

8. A device according to claim 7, wherein said pulses are of a time duration that is shorter than the time taken the ion stream to reach said second electrode.

9. A device according to claim 7, and wherein said means for applying a direct voltage comprises means for applying a direct voltage to both said first and second electrodes, of the same polarity, said polarity being the same as the polarity of the generated ions.

10. A device according to any claim 7, wherein said first electrode is a needle shaped electrode.

11. A device according to any of claim 7, wherein said second electrode is generally ring shaped.

12. A device for generation of a stream of ions, which includes:

a housing, having first and second openings;

a first electrode located between said first and second openings;

a second electrode located adjacent to said second opening, spaced from said first electrode by a predetermined spacing;

means for operating said first and second electrodes so as to cause corona discharge generation of a stream of ions from said first electrode to said second electrode;

means, located between said first electrode and said first opening, for applying a negative pressure to the interior of said housing, thereby to form an airstream flowing from said second opening towards said first opening, and thereby to remove ozone formed by the corona discharge.

13. A device according to claim 12, and also including an adsorbing filter for ozone neutralization, located upstream of said first opening.

* * * * *